United States Patent [19]

Sumrall

[11] Patent Number: 4,536,142

[45] Date of Patent: Aug. 20, 1985

[54] IMPELLING MECHANISM

[76] Inventor: Howell M. Sumrall, 4447 Marraco Dr., San Diego, Calif. 92115

[21] Appl. No.: 549,896

[22] Filed: Nov. 9, 1983

[51] Int. Cl.[3] ..... F04C 2/00; F04C 18/00

[52] U.S. Cl. ..... 418/227

[58] Field of Search ..... 418/225-227, 418/15

[56] References Cited

U.S. PATENT DOCUMENTS

| | | | |
|---|---|---|---|
| 2,919,062 | 12/1959 | Tryhorn | 418/227 |
| 2,920,576 | 1/1960 | Pedersen | 418/227 |
| 3,260,248 | 7/1966 | Lyle | 418/227 |

*Primary Examiner*—Leonard E. Smith
*Assistant Examiner*—Jane E. Obee
*Attorney, Agent, or Firm*—Charles C. Logan, II

[57] ABSTRACT

An impelling mechanism that can be operated as a single-stage compression or expansion positive-displacement rotary engine or compressor. The impelling mechanism has a housing defined by an upper casing and a lower casing. An annular shaped swept volume chamber is formed in the upper casing. A plurality of blade members are pivotally supported on a disc-shaped rotor that is keyed to a shaft passing through the housing. These blade members travel within the swept volume chamber and have their attitude maintained at the same orientation throughout the 360 degrees of revolution of the rotor. The blade members each have a crankshaft attached to their bottom ends which have a first crankshaft throw and a second crankshaft throw. These crankshaft throws are journaled in the finger portions of their respective blade control yokes. These blade control yokes have their axis of rotation laterally offset from the axis of the drive shaft and their own axes are 90 degrees offset from each other. The rotor rotates in one direction and the blades rotate in the opposite direction around their own axes at the same rate as the rotor.

16 Claims, 4 Drawing Figures

IMPELLING MECHANISM

BACKGROUND OF THE INVENTION

The invention relates to an impelling mechanism that can be utilized either as a rotary engine or a rotary pump.

In the past rotary engines have been designed with blade members rotatably mounted upon the rotor of the engine. One example of such structure is illustrated in U.S. Pat. No 619,730. Dobbin's rotary engine utilizes a plurality of gears to control the attitude of his blade members as they travel through his swept volume chamber.

In another rotary compressing, displacing or expanding machine that is illustrated in U.S. Pat. No. 2,919,062, the swept volume chamber has been designed so that it rotates while the blades remain stationary. A complex gearing mechanism is required for operation of this machine.

In U.S. Pat. No. 3,260,248 a rotary engine is disclosed having piston members 19 mounted upon the rotor R. Lyle's engine also requires a complex gearing mechanism to maintain the proper orientation of blade members.

It is an object of the invention to provide a novel impelling mechanism that does not require any gears or timing chain to control the attitude of its blade members.

It is also an object of the invention to provide a novel impelling mechanism that can be used as a rotary pump or as a rotary engine.

It is another object of the invention to provide a novel impelling mechanism that has the blade members mounted on the rotor member and the rotor member rotates together with the shaft of the impelling mechanism while the swept volume chamber remains stationary.

It is an additional object of the invention to provide a novel impelling mechanism that is economical to manufacture and assemble.

It is a further object of the invention to provide a novel impelling mechanism that that has its blade members mounted on crankshafts each having a first and a second crank throw.

SUMMARY OF THE INVENTION

Figure 4:
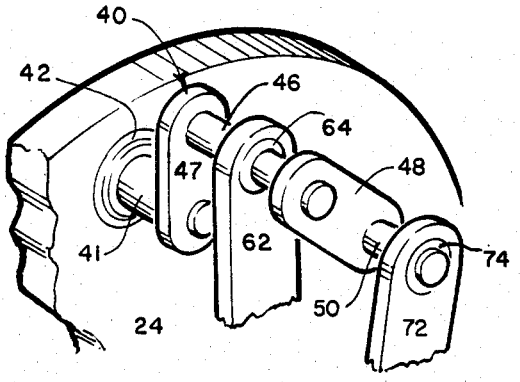
FIG. 4 is a partial perspective view of the bottom of one of the crankshafts and the manner in which its crankshaft throws are captured.

Applicant's invention relates to single-stage compression or expansion positive-displacement rotary engine or compressor. It comprises a rotor fitted with blades, sealing ring segments, and blade crankshafts each of which has a first and a second crankshaft throw whose axes are both laterally offset from the main drive shaft axis and also whose axes are separated from each other by 90 degrees. The housing of the impelling mechanism is separated into an upper casing and a lower casing. The upper casing incorporates the two swept volume chambers, two input ports, two outlet ports, and two restrictive passages for blade and sealing ring passage. This upper casing also provides the inner, outer and top walls for the swept volume and restrictive passage chambers. The lower casing forms the remainder of the stationary housing and contains two fixed oversized and offset dead centers around which the blade control yokes rotate. The distance of the offset is equal to the throw (center of blade shaft to center of crank pin journal) and these two axes are also separated by 90 degrees. The oversize permits main shaft penetration and load bearing support. The perimeter bearing of the rotor is loaded in two modes. It assumes part of the centrifugal load and rigidly holds the rotor in position for minimum clearance.

In applicant's device the rotor rotates in one direction while the blades rotate around their own axes in the opposite direction at the same rate as that of the rotor. The effect is that of moving a compass in a circular path. The needle does not lose its orientation.

In other designs of this type, the chambers rotate around the blades which rotate in a fixed position to accommodate restricted opening passage. The rotating mass is substantially greater.

In applicant's impelling device, the rotor may be much lighter in construction and further maintain close tolerances due to being controled by the perimeter bearings. Obviously, exact control of blade attitude, due to close tolerance, must be maintained. For this reason blade crankshafts with two crank pin journals separated by 90 degrees are used. A single crank pin journal cannot exert control at 0 degrees and 180 degrees. At these two positions, the other crank pin is exerting maximum control. Thus applicant is able to control blade attitude exactly with no chain, gear, or type devices that are subject to wear or failure.

Because there is pressure working against unequal areas (wide side vs. thickness of the blade) it becomes necessary to provide the greatest aspect ratio (blade width vs. thickness) possible. These two forces are cancelling and thereby lower the efficiency of the device by the amount common to both areas. The sealing ring segments seal that portion between blade spacings.

By employing an odd number of blades, torque impulses will not be as noticeable as it would be with opposite blades at the same positions simultaneously.

Another aspect of applicant's device is that either or both input-output sides may be selected according to load requirements. Control valves in either input will allow this option.

Previous impelling mechanisms have embraced either fluids or moderate pressures. In order to provide a far wider application in temperature, pressure and speed, certain considerations have to be met. Positive sealing, fewer operating parts, lighter components, and exact control over the blades must be exercised. Another parameter must also be introduced in that the deflection of the moving mass consumes energy. The greatest effiency that can be achieved in any single stage expansion is positive displacement linear expansion. In applicant's design the flow is essentially linear.

Recent achievements in ceramics will allow the rotor and blades to be fabricated from metal frames that are encased within ceramic sheaths. The extremely low coefficient of expansion along with the smooth finish and when rigidly supported by the perimeter bearings will provide the closest tolerances that present day technology can support. It must be realized that applicant's invention is not restricted to the selection of these materials as other materials may be selected. However, for the high temperature that may be encountered this selection is suggested.

DESCRIPTION OF THE PREFERRED EMBODIMENT

Applicant's novel impelling mechanism is designed to function as a pump for fluids or as a rotary engine driven by a fluid medium. The novel impelling mechanism is generally designated numeral 10 and will be described by referring to FIGS. 1–4.

The impelling mechanism has housing 12 formed from a lower casing 14 and upper casing 16. Upper casing 16 has a pair of swept volume chambers 18 located therein. These chambers are formed by inner side wall 20, outer side wall 21, top wall 22 and a portion of the top surface of rotor 24.

A pair of fluid input ports 26 and 27 are in communication with swept volume chambers 18 as are fluid output ports 28 and 29.

A main drive shaft 30 passes through housing 12 and is rotationally supported therein by ball bearing race assemblies 32 and 34. Rotor 24 is fixedly secured to main shaft 30 by key member 36 and they rotate as one. Around the perimeter of rotor 24, a plurality of blade members 38 have crankshafts 40 extending from their lower end that are journalled in ball bearing race assemblies 42 mounted in rotor 24. Ball bearing race assembly 44 journals the outer perimeter edge of rotor 24 with the inner surface of upper casing 16.

Crankshafts 40 have a first crankshaft throw 46 attached to the main shaft portion 41 by a connecting member 47. A connecting member 48 has its one end attached to first crankshaft throw 46 and its other end attached to second crankshaft throw 50.

A hub 52 extends axially inwardly from the central area of lower casing 14 and it has a pair of offset discs 54 and 56 formed thereon. The axis of hub 52 is x-axis which is the main axis of drive shaft 30. Offset disc 54 has an axis $x_2$ which is displaced from the main axis $x_1$ by a distance m. The distance m is equal to the distance between the axis of shaft 41 of one of the crankshafts 40 and the axis of one of the first crankshaft throws. Blade control yoke 60 has a ring portion 61 that is journaled about offset disc 54. It has a plurality of finger portions 62 extending radially outwardly therefrom and each has a ball bearing race assembly 64 within which is journaled the first crankshaft throw 46.

While the $x_2$ axis of offset 54 is located a distance m away from the $x_1$ axis of the main drive shaft on the y-axis, $x_3$ is the axis of offset disc 56 and it is spaced a distance m from $x_1$ axis. The $x_2$ axis and the $x_3$ axis are 90 degrees offset from each other upon the respective y-axis and z-axis. Blade control yoke 70 has a ring portion 71 that is journaled on offset disc 56. Blade control 70 also has a plurality of radially extending fingers 72 and they each have a ball bearing race assembly 74 mounted therein and in this is journaled the second crankshaft throw 50 of each of the crankshafts 40.

Figure 1:
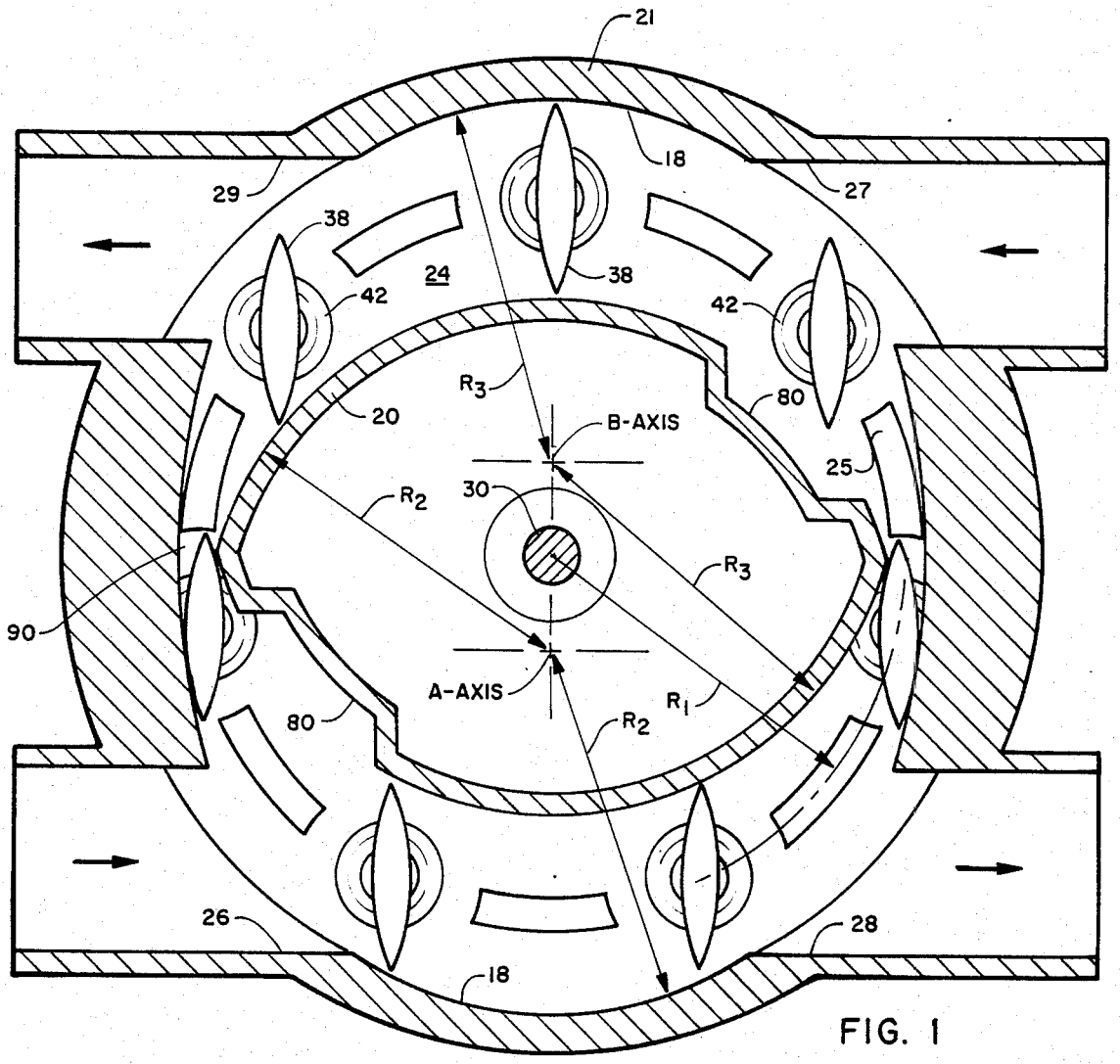
FIG. 1 is a horizontal cross section view taken along lines 1—1 of FIG. 3 but illustrating the entire width of said impelling mechanism.
Figure 3:
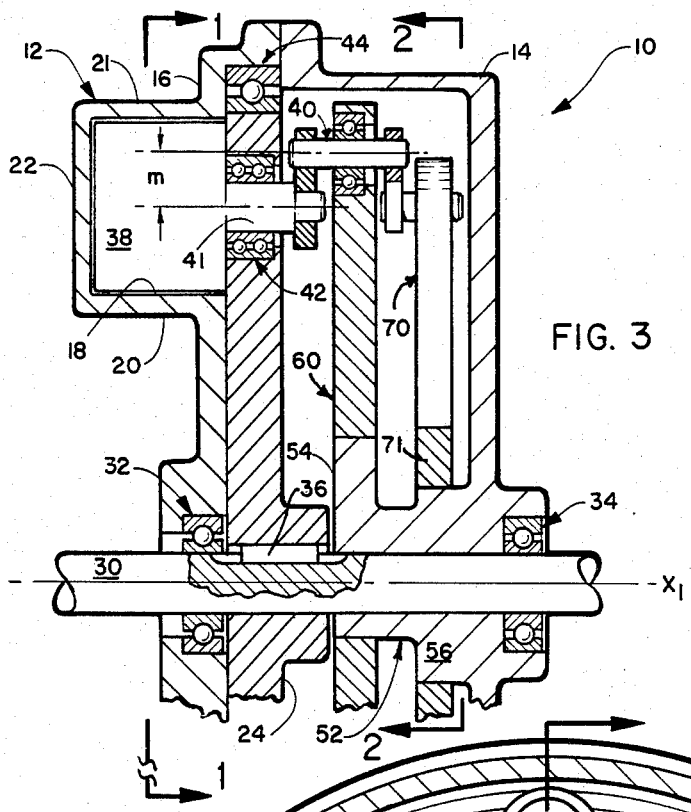
FIG. 3 is a vertical cross section view taken along lines 3—3 of FIG. 2.
Figure 2:
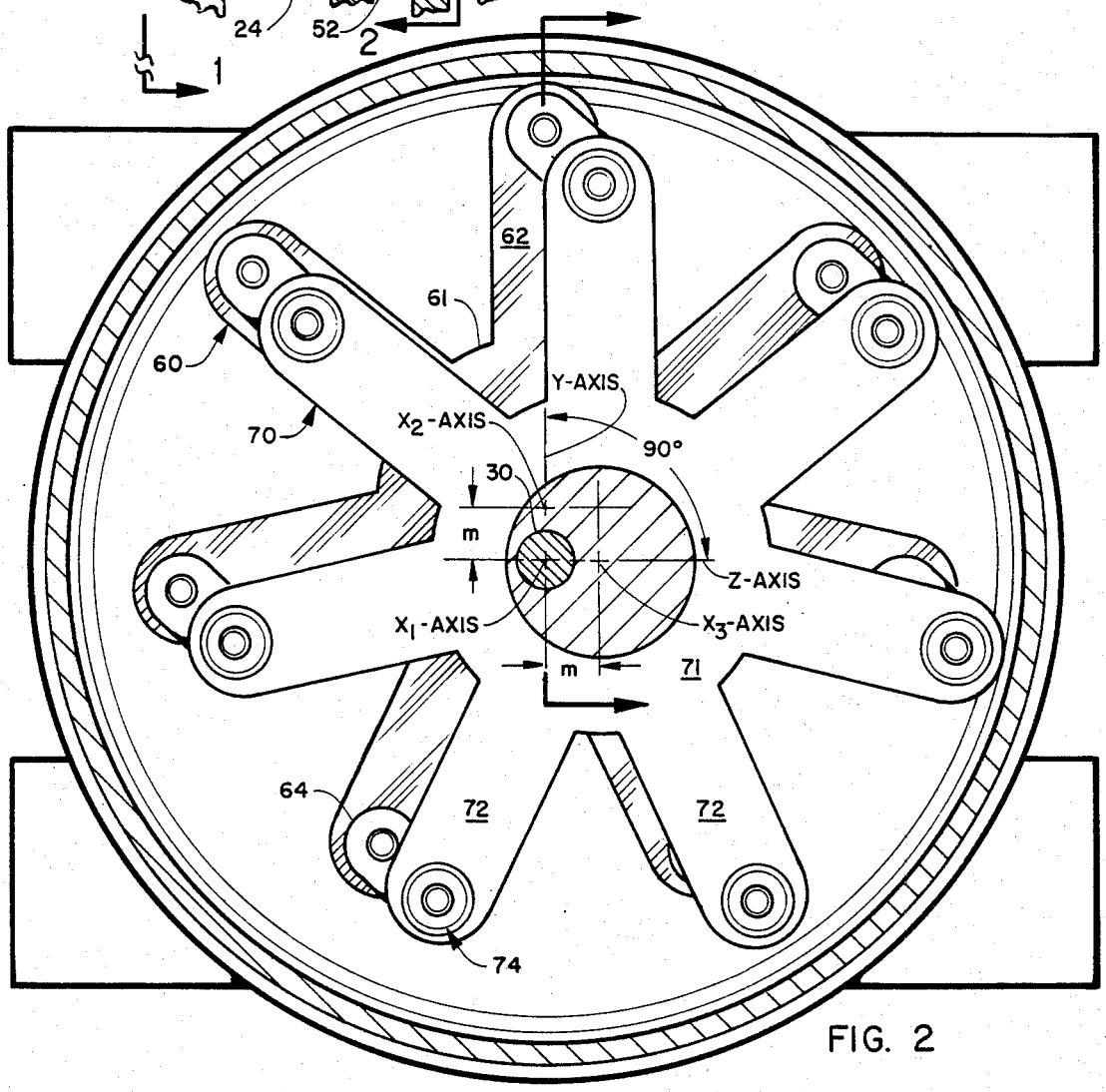
FIG. 2 is a horizontal cross section view taken along lines 2—2 of FIG. 3 but illustrating the entire width of said impelling mechanism.

Referring to FIG. 1, the different inner wall surfaces of the swept volume chambers 18 have different radii identified which are used in forming these surfaces. From A-axis, a radius $R_2$ is drawn to the lower inside surface of outer side wall 21 and this same radius is used to describe the inner surface of inner side wall 20 on the top swept volume chamber 18. Likewise a radius $R_3$ is drawn from the B-axis and its describes the inner wall surface of outer side wall 21 in the upper swept volume chamber and the inner wall surface of the lower swept volume chamber 18. A radius $R_1$ describes a circle about the $x_1$ axis, and all the axes of the various blade members 38 lie on this circle. The A and B axes only importance recides in their use in defining the contour of the interior surface of walls 18 and 20 of the chambers formed in upper casing 16.

The recessed contours 80 for the inner walls are only necessary in the engine version. They maybe omitted in the version that is used as a compressor.

Extending upwardly from the top surface of rotor 24 are a plurality of sealing ring segments 25. These segments have their center line located on the circle described by radius $R_1$. They are spaced apart by a distance equal to the width of blade members 38. The swept volume chambers 18 have a pair of restricted passage chambers 90.

What is claimed is:

1. An impelling mechanism comprising:

a housing defined by an upper casing and a lower casing, at least one swept volume chamber formed in said upper casing, at least one fluid input port in communication with said swept volume chamber, at least one fluid output port in communication with said swept volume chamber;

a shaft oriented substantially perpendicular to the top wall of said upper casing with said shaft passing therethrough and being journaled to rotate freely with respect to said upper casing;

a rotor member fixedly mounted on said shaft and being located in said housing, a portion of the top surface of said rotor member forming the bottom wall of said swept volume chamber, a plurality of blade members each of which is mounted on its own crankshaft, said blade members being positioned within said swept volume chamber and their crankshaft being oriented substantially perpendicular to said rotor member and being journaled therein; and means for controlling the blade attitude of each of said blade members so that they all maintain the same attitude as the rotor member travels through its 360 degree revolution comprising said crankshafts each having at least one crankshaft throw that is journaled in a blade attitude control member that is journaled about a disc member within which said shaft is journaled, said disc having a fixed relationship with said lower casing.

2. An impelling mechanism as recited in claim 1 wherein said rotor member has a plurality of sealing ring segments extending upwardly from the top surface of said rotor member, one of said sealing ring segments is located between each blade member.

3. An impelling mechanism as recited in claim 2 wherein the width of said blade members is substantially the same as the spacing between adjacent sealing ring segments.

4. An impelling mechanism as recited in claim 3 wherein the pivot axis of all of said blade members lies on a radius $R_1$ whose axis is the axis of said shaft.

5. An impelling mechanism as recited in claim 4, wherein said sealing ring segments also lie on said $R_1$ radius.

6. An impelling mechanism as recited in claim 1 wherein the axis of said blade attitude control member lies parallel to the axis of said shaft and laterally offset therefrom a predetermined distance.

7. An impelling mechanism as recited in claim 6 wherein said crankshafts have at least two crankshaft throws and each is journaled in its own blade attitude control member that is itself journaled about its own disc member that in turn is journaled on said shaft.

8. An impelling mechanism as recited in claim 7 wherein the axis of said blade attitude control members both lie parallel to the axis of said shaft and they are both laterally offset from said shaft and each other a predetermined distance.

9. An impelling mechanism as recited in claim 8 wherein the axes of said attitude control members lie on separate radii emanating from the axis of said shaft and these radii are offset from each other by 90 degrees.

10. An impelling mechanism as recited in claim 9 wherein the axes of said attitude control members are each spaced an equal distance from the axis of said shaft.

11. An impelling mechanism as recited in claim 1 wherein said swept volume chamber has an annular horizontal cross-section.

12. An impelling mechanism as recited in claim 11 wherein there at least two fluid input ports and at least two fluid outlet ports, each of which are in communication with said swept volume chamber.

13. An impelling mechanism as recited in claim 11 wherein said rotor member is formed in the shape of a circular disc.

14. An impelling mechanism as recited in claim 13 further comprising perimeter bearings located between the outer radial surface of said rotor member and the interior wall of said housing.

15. An impelling mechanism as recited in claim 11 wherein there are an uneven number of blade members rotatably mounted on said rotor member.

16. An impelling mechanism as recited in claim 15 wherein there are at least five blade members rotatably mounted on said rotor member.

* * * * *